US008915487B2

(12) United States Patent
James

(10) Patent No.: US 8,915,487 B2
(45) Date of Patent: Dec. 23, 2014

(54) BARRIERS

(75) Inventor: Dallas Rex James, North Harbour (NZ)

(73) Assignee: Valmont Highway Technology Limited, Auckland (NZ)

( * ) Notice: Subject to any disclaimer, the term of this patent is extended or adjusted under 35 U.S.C. 154(b) by 0 days.

(21) Appl. No.: 13/197,427

(22) Filed: Aug. 3, 2011

(65) Prior Publication Data

US 2012/0037867 A1 Feb. 16, 2012

(30) Foreign Application Priority Data

Aug. 12, 2010 (NZ) ..... 587332

(51) Int. Cl.
*E01F 15/04* (2006.01)
*E01F 15/08* (2006.01)

(52) U.S. Cl.
CPC ..... *E01F 15/085* (2013.01)
USPC ..... 256/13.1

(58) Field of Classification Search
USPC ..... 256/13.1; 403/168
See application file for complete search history.

(56) References Cited

U.S. PATENT DOCUMENTS

| | | | | |
|---|---|---|---|---|
| 3,094,197 | A * | 6/1963 | Attwood | 52/100 |
| 3,308,724 | A * | 3/1967 | Smith | 404/7 |
| 3,603,562 | A * | 9/1971 | Glaesener | 256/13.1 |
| 4,869,040 | A | 9/1989 | Howell | |
| 5,127,760 | A * | 7/1992 | Brady | 403/230 |
| 5,230,582 | A * | 7/1993 | Schmitt et al. | 404/6 |
| 5,391,016 | A | 2/1995 | Ivey | |
| 5,531,540 | A * | 7/1996 | Wasserstrom et al. | 404/6 |
| 5,664,905 | A | 9/1997 | Thompson | |
| 7,168,882 | B1 * | 1/2007 | Owen | 404/6 |
| 7,600,942 | B2 * | 10/2009 | Yodock et al. | 404/6 |
| 7,699,293 | B2 | 4/2010 | James | |
| 2001/0048846 | A1 | 12/2001 | Ochoa | |
| 2002/0109131 | A1 * | 8/2002 | Smith et al. | 256/13.1 |
| 2004/0262588 | A1 * | 12/2004 | Bronstad | 256/13.1 |
| 2005/0007507 | A1 | 1/2005 | Ono | |
| 2005/0036832 | A1 | 2/2005 | Smith et al. | |
| 2005/0047862 | A1 | 3/2005 | Smith et al. | |
| 2005/0063777 | A1 | 3/2005 | Smith et al. | |
| 2006/0200966 | A1 * | 9/2006 | Bronstad | 29/428 |
| 2007/0102689 | A1 | 5/2007 | Alberson | |
| 2012/0104337 | A1 * | 5/2012 | Hur | 256/13.1 |

FOREIGN PATENT DOCUMENTS

| | | |
|---|---|---|
| EP | 0924348 | 6/1999 |
| EP | 1612333 | 1/2006 |
| NZ | 528396 | 9/2004 |

* cited by examiner

*Primary Examiner* — Joshua Kennedy
(74) *Attorney, Agent, or Firm* — Greer, Burns & Crain, Ltd.

(57) ABSTRACT

A barrier is provided, including opposed longitudinal side members separated by a gap, supports which hold the side members above the ground; and at least one U-shaped member when viewed in transverse cross section which is/are connected to the opposed members to span between the gap and wherein the at least one U-shaped member does not contact the supports.

9 Claims, 3 Drawing Sheets

BARRIERS

STATEMENT OF CORRESPONDING APPLICATIONS

This application is based on the Provisional specification filed in relation to New Zealand Patent Application Number 587332, the entire contents of which are incorporated herein by reference.

TECHNICAL FIELD

The present invention relates to improvements in barriers. In particular, the present invention relates to temporary barriers.

BACKGROUND

At present a multitude temporary barriers exist for redirecting vehicles.

However, most of these barriers have sections which are either of a heavy construction or require water or other ballast to be added in order to provide sufficient resistance to an impact in order to redirect a vehicle. Thus transportation is difficult for heavy barrier sections or time consuming if water is to be added/removed either following, or prior to, transportation.

It would therefore be useful if there could be provided a temporary barrier which could absorb impact energy from errant vehicles whilst having a more lightweight construction than most existing temporary barrier sections as well as not requiring ballast to be added/removed in situ.

It would be useful if there could be provided a barrier which is relatively cheap to manufacture.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It is an object of the present invention to address the foregoing problems or at least to provide the public with a useful choice.

Further aspects and advantages of the present invention will become apparent from the ensuing description which is given by way of example only.

SUMMARY

According to one aspect of the present invention there is provided a barrier which includes:

opposed longitudinal side members separated by a gap;

supports which hold the side members above the ground;

characterised in that the barrier also includes at least one U-shaped member (when viewed in transverse cross section) which is/are connected to the opposed members so as to span between the gap and wherein said U-shaped member(s) do not contact the supports.

The longitudinal side members may come in a variety of different forms.

In one preferred embodiment the side members may be in the form of W-beam members.

In another embodiment the side members may be box section or U-section beam members.

The gap may generally have a distance of between 200 mm to 500 mm. Preferably the gap is 350 mm.

The supports which hold the side members off the ground may be selected from one or more of the non-exhaustive list of alternatives:

posts;

frameworks;

self supporting structures such as barrels or other containers;

which may rest on, or be attached to, the ground or other support surface, as may be appropriate.

According to a further aspect of the present invention there is provided a U-shaped member which is formed from a sheet of flat material and which has a number of holes in the opposed edges folded so as to create the arms of the U-shape.

The U-shaped members may take on a variety of different configurations.

In one preferred embodiment the U-shaped members may have side arms which are equal in length to the connecting base web.

In another preferred embodiment the U-shaped members may have side arms significantly shorter in length than that of the connecting base web.

In preferred embodiments the U-shaped member may be in the form of a tray.

Preferably the U-shaped member may be formed from a sheet of flat material which has at least two opposed edges folded so as to create the arms of the U.

Most preferably the sheet of flat material may have a thickness of substantially 2-3 mm. In one preferred embodiment the sheet of material has a thickness of 3 mm.

In preferred embodiments the U-shaped member may be made from a sheet of mild steel.

The applicant has observed that the use of the U-shaped member provides structural integrity to the barrier (i.e. stiffness) which enables the barrier to be easily lifted and moved.

Additionally the U-shaped member due to its relatively thin construction is capable of yielding to the force of an impact and deforming so as to absorb impact energy with minimal transfer of impact energy to the non-impact side of the barrier. Thus, enabling the barrier to act like a crash cushion.

According to a still further aspect of the present invention there is provided a barrier which includes a U-shaped member substantially as described herein.

Thus preferred embodiments may have a number of advantages over the prior art which can include:

Ease of construction;

Ease of transportation; and

Relatively cheap to manufacture.

BRIEF DESCRIPTION OF THE DRAWINGS

Further aspects of the present invention will become apparent from the following description which is given by way of example only and with reference to the accompanying drawings in which.

DETAILED DESCRIPTION

Figure 1:
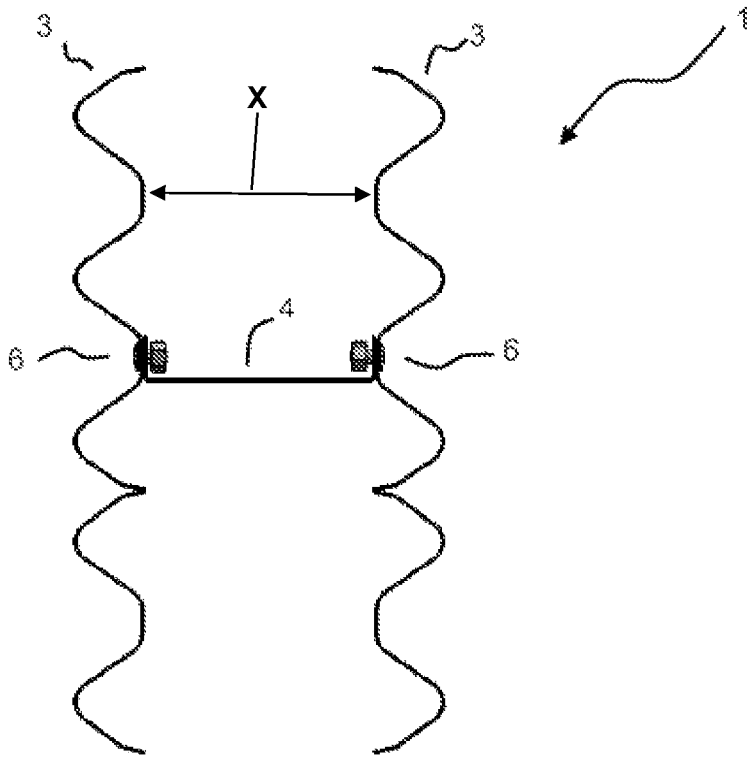
FIG. 1 shows a cross sectional schematic view of a barrier through line A in FIG. 2 in accordance with one preferred embodiment of the present invention.
Figure 2:
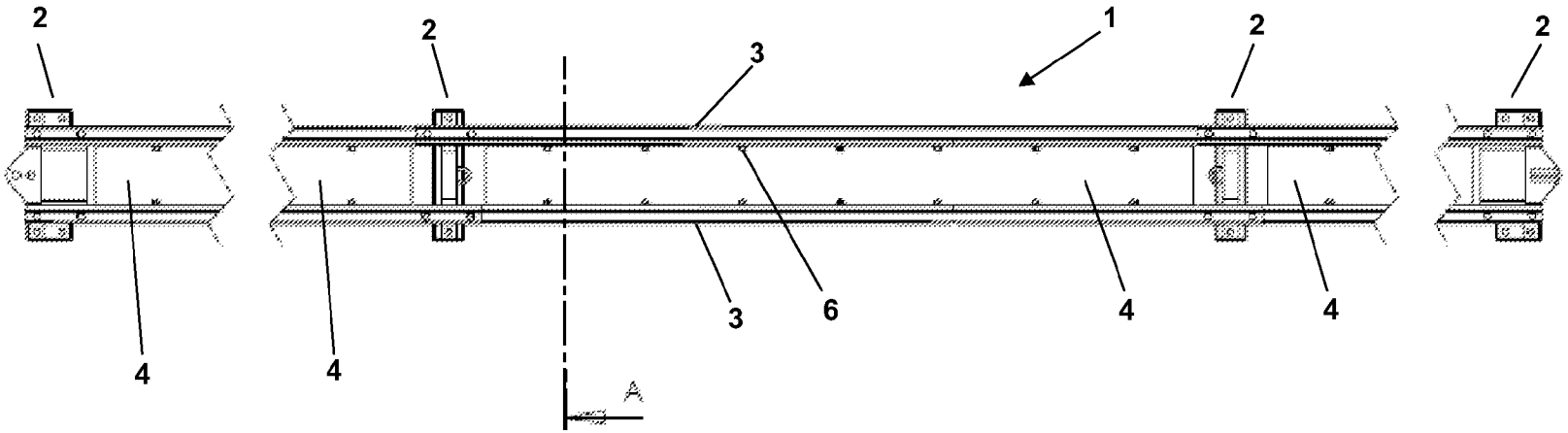
FIG. 2 shows a plan view of a barrier in accordance with one preferred embodiment of the present invention.
Figure 3:
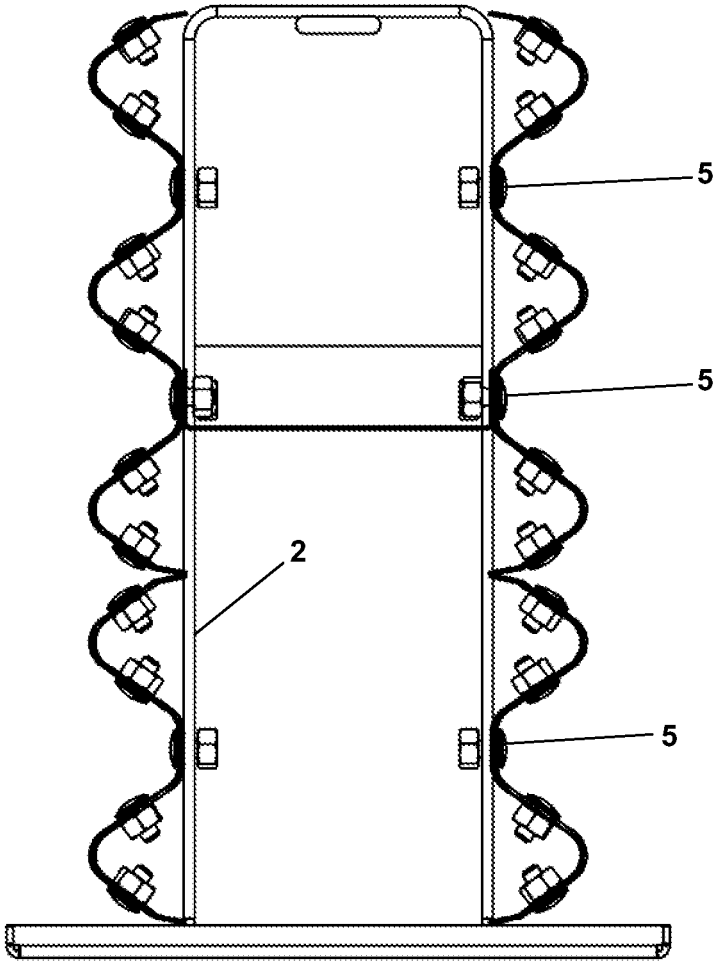
FIG. 3 shows an end on view of a barrier in accordance with one preferred embodiment of the present invention.

With respect to the Figures there is shown a barrier in the form of a road barrier 1. The barrier 1 has supports in the form of frameworks 2 to which W-beam members 3 are bolted with nut and bolt assembly 5. Situated in between W-beam members 3 are U-shaped members 4 which span between the gap X between opposed W-beam members 3. As can be seen the U-shaped members 3 are bolted with nut and bolt assembly 6 to opposed W-beam members 3 but are not bolted or otherwise attached to frameworks 2.

Aspects of the present invention have been described by way of example only and it should be appreciated that modifications and additions may be made thereto without departing from the scope of the appended claims.

What we claim is:

1. A barrier, comprising:

opposed longitudinal side members separated by a gap;

at least two longitudinally spaced apart support frames to which the longitudinal side members are attached to either side thereof, wherein said longitudinally spaced apart support frames rest on, or are attached to, the ground, and hold the opposed longitudinal side members above the ground; and at least one U-shaped member when viewed in transverse cross section which is connected to the opposed longitudinal side members to span between the gap at or proximate to a vertical midpoint of the opposed longitudinal side members, wherein said at least one U-shaped member substantially spans the longitudinal distance between each pair of adjacent longitudinally spaced apart support frames whilst stopping short of actually coming into contact with or longitudinally overlapping said longitudinally spaced apart support frames.

2. The barrier as claimed in claim 1 wherein the gap has a distance of between substantially 200 mm to 500 mm.

3. The barrier as claimed in claim 2 wherein the gap is 350 mm.

4. The barrier as claimed in claim 1 wherein each said U-shaped member is formed from a sheet of flat material which has at least two opposing edges folded so as to create the arms of the U.

5. The barrier as claimed in claim 4 wherein the sheet of flat material has a thickness of substantially 2-3 mm.

6. The barrier as claimed in claim 5 wherein each said U-shaped member is in the form of a tray.

7. The barrier as claimed in claim 1 wherein each said U-shaped member is made from mild steel.

8. The barrier as claimed in claim 1 wherein each said U-shaped member is formed from a sheet of flat material and has a number of holes in opposing edges folded so as to create arms of the U-shaped member.

9. A barrier, comprising:

opposed longitudinal side members each having a top edge, a bottom edge and a height defined by a distance between said top edge and said bottom edge, said top edge of said side members being separated by a gap;

at least two longitudinally spaced apart support frames to which the longitudinal side members are attached to either side thereof, wherein said longitudinally spaced apart support frames rest on, or are attached to, the ground, and hold the side members above the ground; and at least one U-shaped member when viewed in transverse cross section having sides having a height, which is connected to and extends between the opposed side members, said height of said sides of the at least one U-shaped member being less than half the height of said side members, wherein said at least one U-shaped member substantially spans the longitudinal distance between each pair of adjacent longitudinally spaced apart support frames whilst stopping short of actually coming into contact with or longitudinally overlapping, said longitudinally spaced apart support frames.

* * * * *